United States Patent [19]

Kiso

[11] Patent Number: 4,848,036

[45] Date of Patent: Jul. 18, 1989

[54] GRINDING MACHINE FOR DRILL BITS

[75] Inventor: Eijiro Kiso, Osaka, Japan

[73] Assignee: Kabushiki Kaisha Kiso Seisakusho, Osaka, Japan

[21] Appl. No.: 131,555

[22] Filed: Dec. 11, 1987

[30] Foreign Application Priority Data

Jul. 20, 1987 [JP] Japan ..... 62-180571

[51] Int. Cl.[4] ..... B24B 7/00; B24B 9/00

[52] U.S. Cl. ..... 51/96; 51/219 R

[58] Field of Search ..... 51/96, 218 R, 219 R, 51/219 PC

[56] References Cited

U.S. PATENT DOCUMENTS 2,384,899 9/1945 Dixon ..... 51/219 R 2,632,938 3/1953 Kapnick ..... 51/219 PC

*Primary Examiner*—Frederick R. Schmidt

*Assistant Examiner*—David A. Holmes

*Attorney, Agent, or Firm*—Koda and Androlia

[57] ABSTRACT

A grinding machine for grinding a tip of a drill bit including a grindstone rotatably provided on a base; a drill bit holder provided on one side of the grindstone, the drill bit holder being pivotable about an axis parallel to the rotating axis of the grindstone and holding the drill bit in an inclined position at a predetermined angle relative to the grinding surface of the grindstone; and a drill bit feeder which moves the drill bit toward the grindstone so that the tip of the drill bit is brought into contact with the grinding surface and ground by the grindstone. If the drill bit holder is pivoted when the tip of the drill bit is brought into contact with the rotating grindstone, the drill bit held by a drill bit presser mounted on the drill bit holder is turned about its own axis so that the tip is ground into substantially a cone shape with a desirable rake angle and rake angle surface.

7 Claims, 5 Drawing Sheets

GRINDING MACHINE FOR DRILL BITS

BACKGROUND OF THE INVENTION

1. Field of the Invention

The present invention relates to a grinding machine for drill bits which are used as cutting tools and more particularly to a grinding machine for grinding the tip of a twisted drill bit.

2. Prior Art

In a twisted drill bit which has two spiral grooves on the shank, the intersecting portion formed by the grooves and the surface of the tip of the drill bit which is substantially cone shaped forms a cutting edge, and a work piece is cut by this cutting edge. In this type of drill bit, the cutting edge tends to break when used for a long period of time, and thus cutting performance also tends to decrease.

Accordingly, the tip of the drill bit must be ground after a certain period of use in order to maintain preferable cutting performance. When the drill bit is ground, it is necessary to grind the surface of the tip of the drill bit so that it can be formed into a predetermined shape. (Throughout the specification, the surface of the tip of the drill bit is called a rake angle surface, and the angle between this surface and an axial center of the drill bit is called the rake angle).

However, it is not easy to grind the tip end surface of the drill bit into the predetermined shape. Grinding is usually done by a drill bit grinding machine which is designed solely for grinding drill bits. However, this machine is relatively large and complex in structure. Grinding can also be accomplished by a skilled expert manually grinding the tip of the drill bit. There are no other reliable ways to grind the drill bit except the above-described two ways.

The problem with the drill bit grinding machine is that the machine is relatively expensive. On the other hand, when the drill bit is ground manually, the problem is that only a skilled expert can grind the tip of the drill bit into a predetermined shape.

SUMMARY OF THE INVENTION

Accordingly, the present invention was made with the above-described problems and disadvantages in mind.

It is a primary object of the present invention to provide a relatively inexpensive grinding machine for drill bit which anyone, not only an expert, can easily use to grind the tip of a drill bit into a predetermined shape.

In keeping with the principles of the present invention, the objects are accomplished with a unique drill bit grinding machine which includes: a base; a grindstone provided above the base; a driving means which rotates the grindstone; a drill bit holding means provided at one side of the grindstone, the drill bit holding means being pivotable about an axis which is parallel to the rotating center of the grindstone and inclined at a predetermined angle relative to a grinding surface of the grindstone; and a drill bit feeding means which moves the drill bit held by the drill bit holding means toward the grindstone so that the tip end of the drill bit is brought into contact with the grinding surface of the grindstone.

With the above structure, when the drill bit held by the drill bit holding means and is moved toward the grindstone by the drill bit feeding means, the tip of the drill bit is brought into contact with the grinding surface of the grindstone and ground. Since the drill bit is held inclined at a predetermined angle by the drill bit holding means relative to the grinding surface of the grindstone, the tip of the drill bit also comes into contact at the thus determined angle to the grinding surface.

Furthermore, the drill bit holding means pivots about an axis which is parallel to the rotating axis of the grindstone. Accordingly, if the grindstone is rotated with the tip of the drill bit kept in contact with the grinding surface and the drill bit holding means is pivoted a specific amount about the parallel axis, the surface of the tip of the drill bit can be ground into a predetermined curved surface.

Thus, the present invention provides a drill bit grinding machine which anyone can use to grind drill bits.

DETAILED DESCRIPTION OF THE INVENTION

Figure 1:
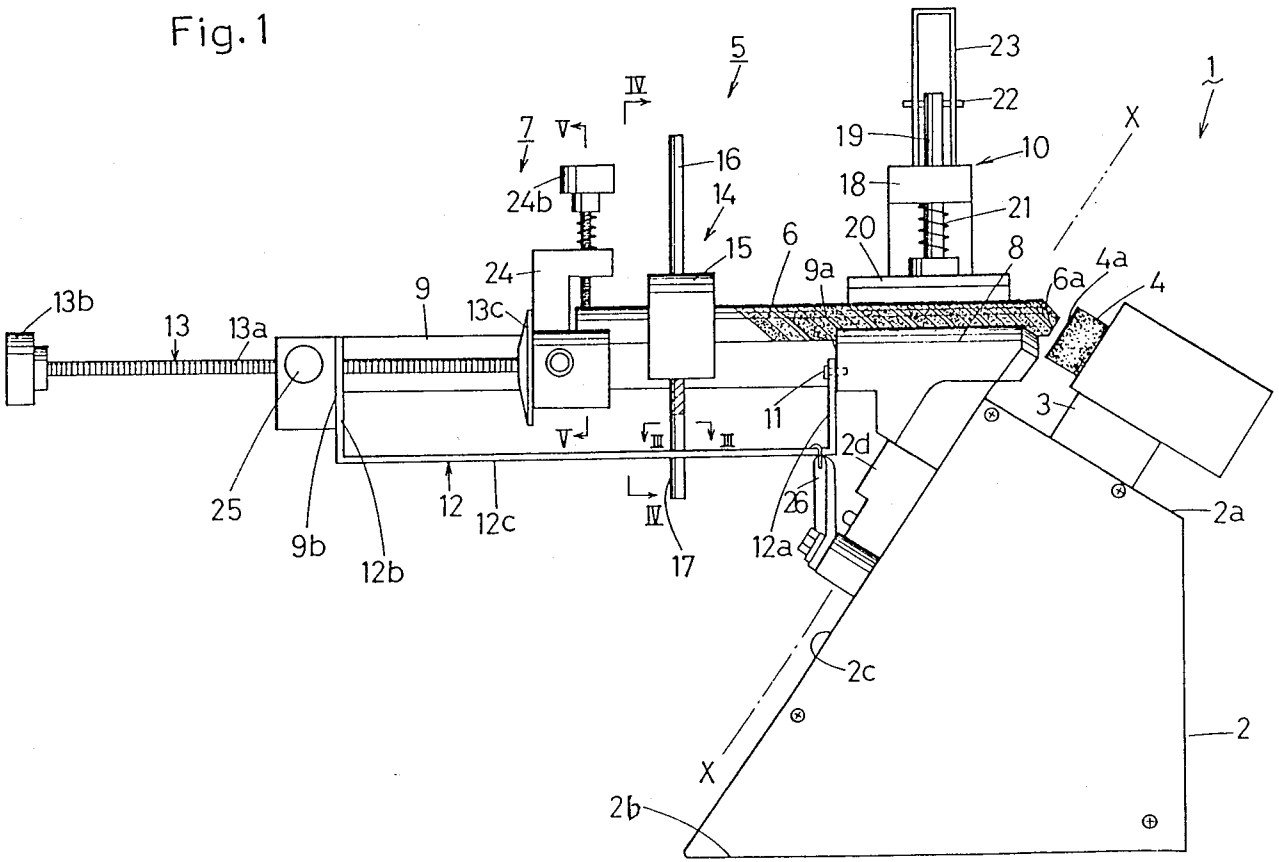
FIG. 1 is a side view of the grinding machine for drill bit in accordance with an embodiment of the present invention.
Figure 2:
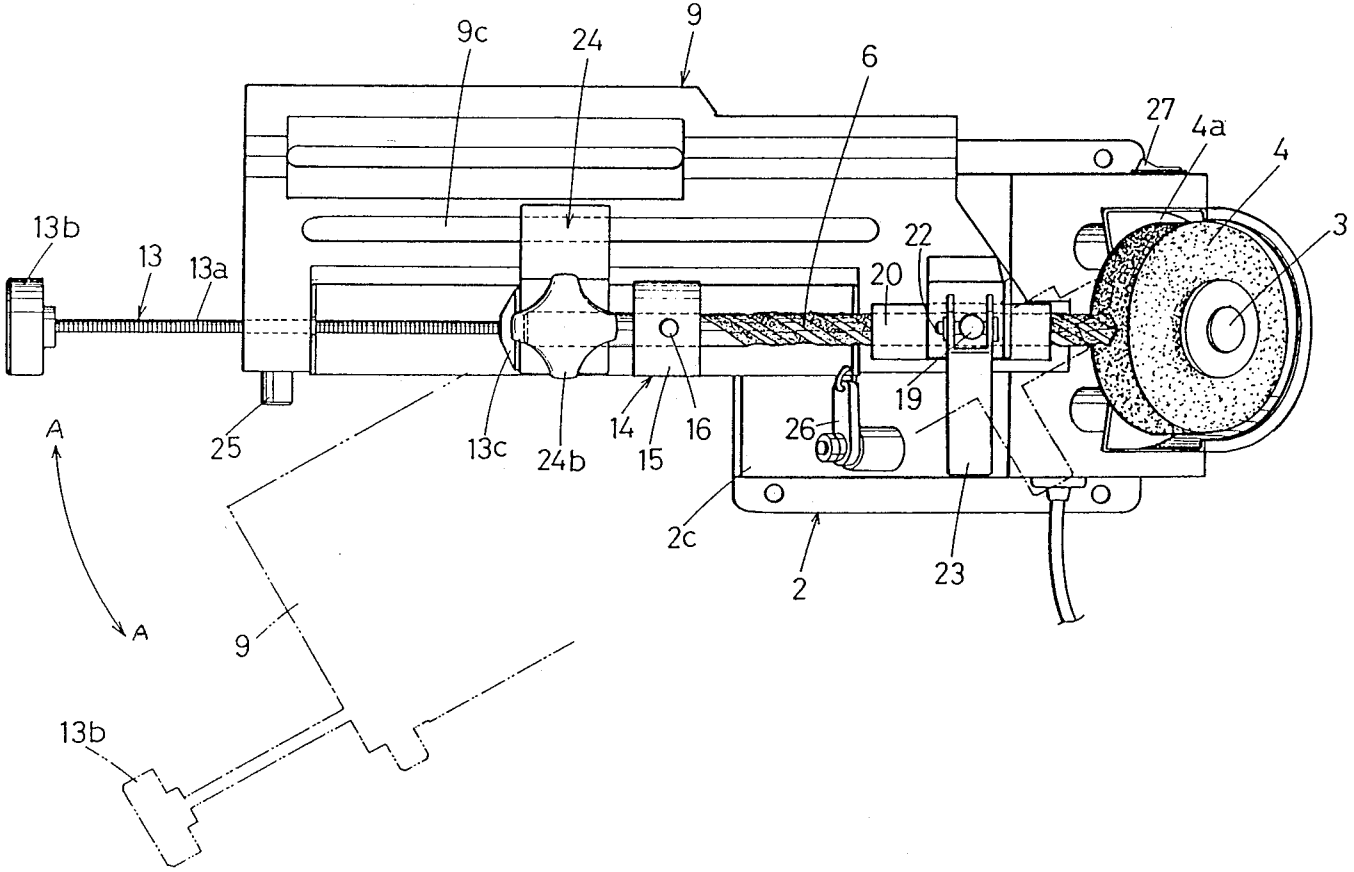
FIG. 2 is a plan view thereof.
Figure 3:
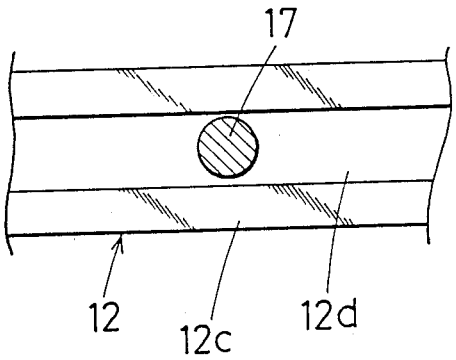
FIG. 3 is an enlarged horizontal cross sectional view the line III—III of FIG. 1.

As seen from the FIGS. 1 and 2, a drill bit grinding machine 1 substantially includes a base 2 which contains a motor (not shown), a grindstone 4, and a drill bit holding means 5. The grindstone 4 is provided inclined above the base 2 and rotated by a shaft 3. The drill bit holding means 5 is provided on one side of the grindstone 4.

The drill bit grinding machine 1 further includes a drill bit feeding mechanism 7. With this feeding mechanism 7, a drill bit 6, which is held by the drill bit holding means 5, is moved toward the grindstone 4 so that a tip 6*a* of the drill bit 6 is brought into contact with a grinding surface 4*a* of the grindstone 4.

The top 2*a* of the base 2 of this embodiment is inclined relative to the bottom 2*b*. The back 2*c* (the side the drill bit holding means 5 is provided on) of the base 2 is inclined at a predetermined angle (approximately 90 degrees in the Figure) relative to the inclined top 2*a*. The shaft 3 projects from the top 2*a* of the base 2, and the grindstone 4 is mounted at the end of the shaft 3.

The drill bit holding means 5 includes a drill bit holding frame 9, a drill bit retainer 10, an angled U-shaped member 12, and a drill bit turning assembly 14. The drill bit holding frame 9 includes a table 8 at the front end and has an angled U-shaped section (U-shaped if seen from above as in FIG. 2) at the middle. The drill bit retainer 10 is provided above the table 8 so that it faces the table 8. The drill bit retainer 10 retains the front portion of the drill bit 6.

The angled U-shaped member 12 is supported by a rod portion 13*a* of a drill bit pressing adjuster 13 of the drill bit feeding mechanism 7. A front end 12*a* of the angled U-shaped member 12 is pivotally fitted by a pin 11 on the front side 9*a* of the angled U-shaped section of the drill bit holding frame 9. A back end 12*b* of the angled U-shaped member 12 is in contact with a back side 9*b* of the angled U-shaped section. The angled U-shaped member 12 is provided with a length-wise cut-out 12*d* (seen in FIGS. 4 and 5) in the bottom 12*c*.

The table 8 is supported by a projection 2*d* provided on the back 2*c* of the base 2. The table 8 can pivot in a direction A—A in FIG. 2 about an axis X of FIG. 1 which is substantially parallel to the shaft 3 of the grindstone 4. The drill bit holding frame 9 holds the drill bit 6 at a predetermined inclined angle relative to the grinding surface 4*a* of the grindstone 4.

Figure 4:
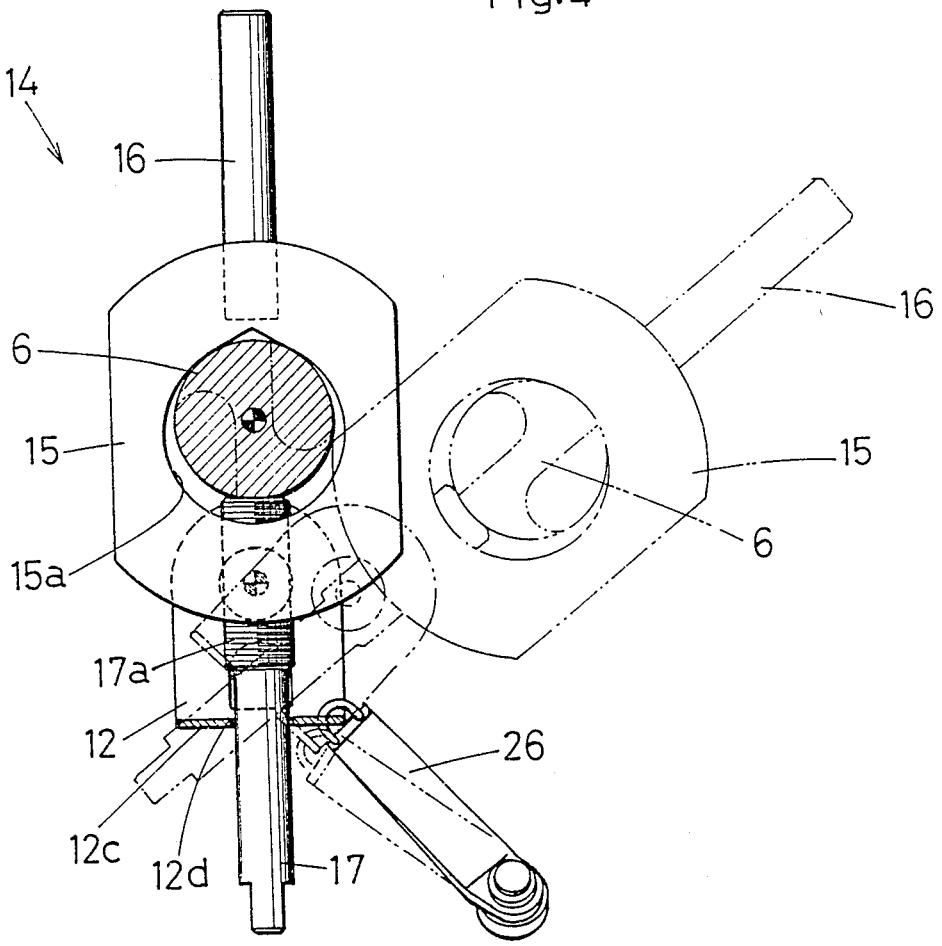
FIG. 4 is an enlarged vertical cross sectional view taken along the line IV—IV of FIG. 1.

As seen from FIG. 4, the drill bit turning assembly 14 includes a drill bit holding member 15 and rod members 16 and 17. The drill bit holding member 15 is provided with a hole 15*a* at the center so that the drill bit 6 can be held therein. The rod members 16 and 17 are respectively fitted into the upper and lower portions of the drill bit holding member 15. In this embodiment, the rod 16 is securely fitted to the drill bit holding member 15, and the other rod 17 is fastened to the drill bit holding member 15 via the threaded portion 17*a*. The tip end of the threaded portion 17*a* is projected into the hole 15*a*, and the lower or middle portion of the rod 17 is inserted into the cut-out 12*d* of the angled U-shaped member 12. Thus, if the rod 17 is tightened when the drill bit 6 is placed in the hole 15*a*, the drill bit 6 is securely held by the drill bit turning assembly 14.

The positional relationship of the rods 16 and 17 should not be limited to the one shown in the Figure. In other words, it is possible to design such that the rod 16 is fastened under the drill bit holding member 15 so that the lower portion thereof is inserted into the cut-out 12*d*.

The drill bit retainer 10 includes a presser bar 19, a presser foot 20 attached to the lower end of the presser bar 19, and a spring 21 provided around the presser bar 19. The presser bar 19 is held by a top section 18 of a vertical column provided at one end of the drill bit holding frame 9. The spring 21 is provided between the presser foot 20 and the top section 18 such that it presses the presser foot 20 downward. An operation handle 23 is held above the presser bar 19 by a pin 22. When the operation handle 23 is in a designated position, the presser foot 20 stays above the table 8. When the operation handle 23 is turned, the presser foot 20 is moved down by the spring 21 so that the drill bit 6 is held between the presser foot 20 and the table 8 as shown in FIG. 2.

The drill bit feeding mechanism 7 includes a drill bit presser 24 and the drill bit pressing adjuster 13.

Figure 5:
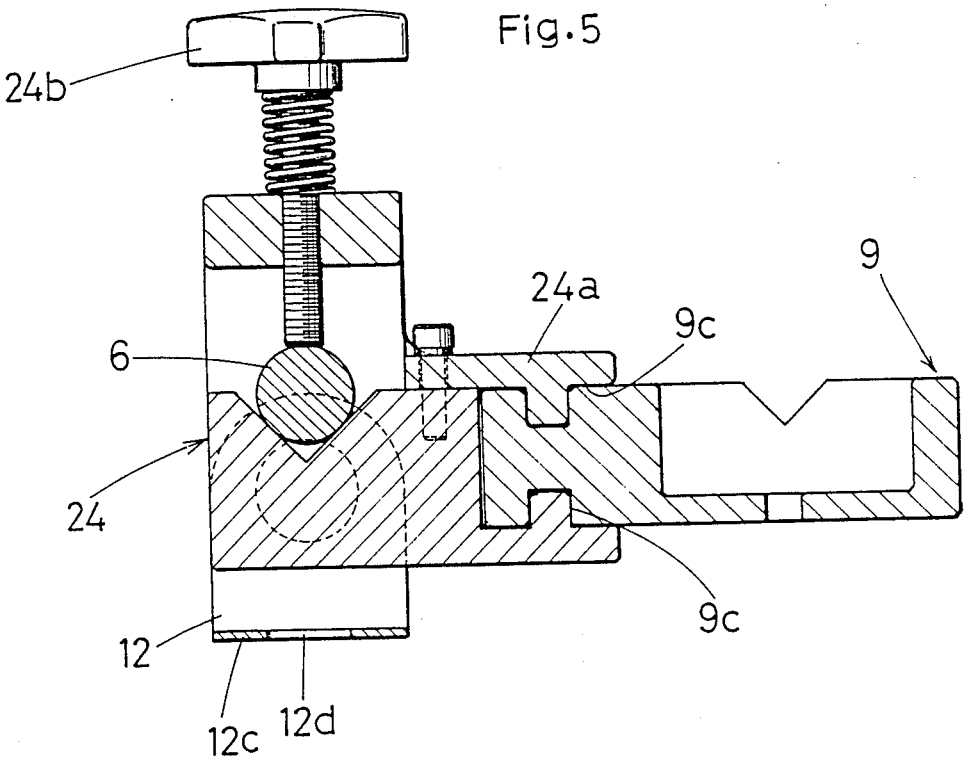
FIG. 5 is an enlarged vertical cross sectional view taken along the line V—V of FIG. 1.

The drill bit presser 24 is designed to travel along the drill bit holding frame 9. More specifically, as shown in FIG. 5, one end 24*a* of the drill bit presser 24 is engaged with guide grooves 9*c* formed on top and bottom surfaces of the drill bit holding frame 9 so that the drill bit presser 24 can travel along these guide grooves 9*c*. Further, the upper portion of the drill bit presser 24 is provided with a drill bit holding screw 24*b*.

The rod portion 13*a* of the drill bit pressing adjuster 13 is screwed into the back surface 9*a* of the angled U-shaped section of the drill bit holding frame 9. The front end of the drill bit pressing adjuster 13 is connected to the drill bit presser 24, and the back end thereof is provided with an operation knob 13*b*. If the operation knob 13*b* is turned to the right, the drill bit presser 24 is advanced toward the grindstone 4, and if it is turned to the other direction, the drill bit presser 24 is moved backward.

At the front end of the drill bit pressing adjuster 13, a disk 13*c* is provided. The disk 13*c* reduces the surface pressure applied onto the drill bit presser 24 when it presses the drill bit 6. Reference numeral 25 is a positioning button provided at the back end of the drill bit holding frame 9. If this positional button 25 is pressed, the drill bit pressing adjuster 13 can be moved axially and then set at a desired position.

In the drill bit grinding machine 1 of this embodiment, a connecting member 26 is utilized. The connecting member 26 is mounted at one end to the back 2*c* of the base 2 and at other end to the bottom 12*c* of the angled U-shaped member 12. With this connecting member 26, the drill bit holding frame 9, etc. are pivoted about the pin 11 of the angled U-shaped member 12 as the center and set at a desired position between the dotted-line position and the solid-line position shown in FIG. 2. Reference numeral 27 is a motor switch mounted on one side of the base 2.

In operation, the drill bit pressing adjuster 13, the drill bit presser 24, and the presser foot 20 of the drill bit retainer 10 are first set at holding positions. Then, the drill bit 6 held in the drill bit turning assembly 14 is set at a designated position together with the drill bit turning assembly 14. The tip and tail ends of the drill bit 6 are respectively placed on the table 8 of the drill bit holding frame 9 and in the drill bit presser 24. At this time, the bottom of the lower rod 17 of the drill bit turning assembly 14 is inserted into the cutout 12*d* of the angled U-shaped member 12.

After the above preparation, the presser foot 20 is moved down so that it holds the tip end of the drill bit 6, and the drill bit holding screw 24*b* of the drill bit presser 24 is tightened. Thus, the drill bit 6 on the drill bit holding frame 9 is inclined at a designated angle to the grindstone 4 which is in front of the tip of the drill bit 6.

When the motor switch 27 is turned ON, the grindstone 4 starts rotating. The operation knob 13*b* of the drill bit pressing adjuster 13 is turned to the designated direction so that the drill bit 6 is moved forward through the drill bit presser 24 until the tip 6*a* of the drill bit 6 comes into contact with the grinding surface 4*a* of the grindstone 4. At this moment, the drill bit presser 24 is advanced together with the drill bit 6 with the lower rod 17 guided by the cut-out 12*d* of the angled U-shaped member 12.

Figure 6:
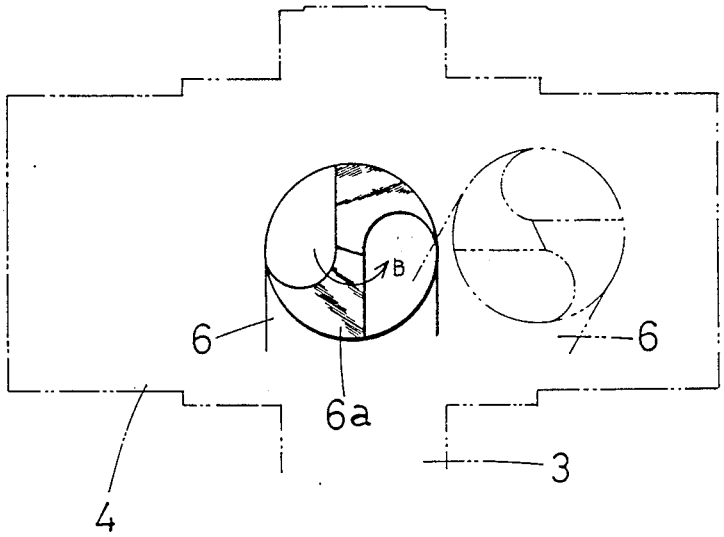
FIG. 6 is a schematic view showing the movement of a tip end of a drill bit viewed from grindstone side.

The drill bit pressing adjuster 13 and the drill bit holding frame 9, etc. are pivoted in the direction A shown in FIG. 2 about the axis X of FIG. 1 with the tip end 6*a* of the drill bit 6 kept in contact with the grinding surface 4*a*. As a result, the angled U-shaped member 12 is turned clockwise about the rod portion 13*a* or the pin 11 as the center. The drill bit turning assembly 14 is connected to the angled U-shaped member 12 by the lower rod 17 which is inserted into the cut-out 12*d* of the angled U-shaped member 12 and is turned in the designated direction. Thus, when the angled U-shaped member 12 is turned as mentioned above, the drill bit 6 is also turned about its axis. Accordingly, when the tip 6*a* of the drill bit 6 is viewed from the grindstone 4 side, one portion of the tip 6*a* is kept in contact with the grinding surface 4*a* and turned in the direction B shown in FIG. 6 until it comes in the position shown by the dotted line. Thus, the tip 6*a* of the drill bit 6 can be ground into substantially cone shape which has a predetermined rake angle and rake angle surface.

I claim:

1. A grinding machine for grinding the tip end of a drill bit comprising:

a base;

a grindstone provided on said base;

a driving means for rotating said grindstone said driving means comprising an electric motor provide in said base;

a drill bit holding means provided on one side of said grindstone, said drill bit holding means being pivotable about an axis parallel to a rotating axis of said grindstone and holding said drill bit in an inclined position at a predetermined angle relative to a grinding surface of said grindstone, said drill bit holding means comprises:

a drill bit holding frame provided with an angled U-shaped section at the middle;

a drill bit retaining means for holding a tip area of said drill bit, said drill bit retaining means being provided above a table means and facing thereto;

an angled U-shaped member with a length-wise cut-out along the bottom surface, said angled U-shaped member being provided in said angled U-shaped section of said drill bit holding frame with its front end being pivotally fitted on a front surface of said angled U-shaped section by a pin and its back end being kept in contact with a back surface of said angled U-shaped section and supported by a rod portion of a drill bit pressing adjuster of said drill bit feeding means; and a drill bit turning means; and a drill bit feeding means which advances said drill bit held by said drill bit holding means toward said grindstone so that a tip end surface of said drill bit is brought into contact with said grinding surface.

2. A grinding machine according to claim 1, wherein said drill bit turning means comprises:

a drill bit holding member provided at its center with a hole into which said drill bit is inserted; and rods respectively mounted on top and bottom of said drill bit holding member, one of said rods being securely fitted to said drill bit holding member and other rod being screwed to said drill bit holding member through a thread formed on the upper portion of said other rod, the top end of said other rod projecting into said hole and the middle through lower portions of said other rod being inserted into said cut-out of said angled U-shaped member, and said drill bit holding member tightly holding said drill bit inserted into said hole.

3. A drill bit grinding machine according to claim 1, wherein said drill bit retaining means comprises:

a rod passing thorough a top piece of a vertical column provided at a designated position of said drill bit holding frame;

a presser foot mounted on a lower end of said rod; and a spring provided between said top piece and presser foot so that said spring presses said presser foot downward.

4. A drill bit grinding machine according to claim 1 further including:

a drill bit holding frame which is provided at the top and bottom surfaces with guide grooves;

a drill bit presser provided at its upper portion with a screw for holding a drill bit, said presser being mounted on said drill bit holding frame with one end engaged with said guide grooves so that said drill bit presser can be moved along said grooves, and a drill bit pressing adjuster, a rod portion of said drill bit pressing adjuster being screwed to a rear surface of an angled U-shaped section and the front end of said rod portion being connected to said drill bit presser and the rear end thereof being provided with an operation means.

5. A drill bit grinding machine according to claim 3, wherein:

said drill bit holding frame is provided at the top and bottom surfaces with guide grooves and a drill bit presser provided at upper portion with a screw for holding a drill bit is mounted on said drill bit holding frame with one end of said drill bit presser being engaged with said guide grooves so that said drill bit presser can be moved along said grooves, and said rod portion of said drill bit pressing adjuster is screwed to a rear surface of said angled U-shaped section, and the front end of said rod portion is connected to said drill bit presser and the rear end thereof is provided with an operation means.

6. A drill bit grinding machine according to claim 2, wherein:

said drill bit holding frame is provided at the top and bottom surfaces with guide grooves and a drill bit presser provided at its upper portion with a screw for holding a drill bit mounted on said drill bit holding frame with one end of said drill bit presser being engaged with said guide groove so that said drill bit presser can be moved along said grooves, and said rod portion of said drill bit pressing adjuster is screwed to a rear surface of said angled U-shaped section, and the front end of said rod portion is connected to said drill bit presser and the rear end thereof is provided with an operation means.

7. A drill bit grinding machine according to claim 3, wherein:

said drill bit holding frame is provided at the top and bottom surfaces with guide grooves and a drill bit presser provided at its upper portion with a screw for holding a drill bit is mounted on said drill bit holding frame with one end of said drill bit presser being engaged with said guide grooves so that said drill bit presser can be moved along said grooves, and said rod portion of said drill bit pressing adjuster is screwed to a rear surface of said angled U-shaped section, and the front end of said rod portion is connected to said drill bit presser and the rear end thereof is provided with an operation means.

* * * * *